US006476699B1

(12) United States Patent
Amano et al.

(10) Patent No.: US 6,476,699 B1
(45) Date of Patent: Nov. 5, 2002

(54) REED SWITCH UNIT

(75) Inventors: Tsutomu Amano; Kazuhiro Ota, both of Nagano (JP)

(73) Assignee: Nissin Kogyo Co., Ltd., Nagano-Ken (JP)

( * ) Notice: Subject to any disclaimer, the term of this patent is extended or adjusted under 35 U.S.C. 154(b) by 0 days.

(21) Appl. No.: 09/615,943

(22) Filed: Jul. 13, 2000

(30) Foreign Application Priority Data

Jul. 19, 1999 (JP) ..... 11-204210
Mar. 9, 2000 (JP) ..... 2000-064489

(51) Int. Cl.[7] ..... H01H 9/00
(52) U.S. Cl. ..... 335/205; 335/151; 340/618
(58) Field of Search ..... 335/205–207, 335/151–3; 439/620–622, 516; 340/618, 623–625

(56) References Cited

U.S. PATENT DOCUMENTS 4,516,101 A * 5/1985 Nemoto et al. ..... 335/205
4,933,655 A * 6/1990 Matsubara ..... 335/151
5,019,795 A * 5/1991 Patal et al. ..... 335/205
5,026,305 A * 6/1991 DelGuidice et al. ..... 439/620
5,458,508 A * 10/1995 Swada ..... 439/620
5,770,792 A * 6/1998 Nakada et al. ..... 340/467
5,785,553 A 7/1998 Sawada
5,827,962 A 10/1998 Guenther et al.

FOREIGN PATENT DOCUMENTS

DE 197 10 453 A1 3/1997
DE 197 20 601 C1 5/1997
JP 56-99080 * 8/1981
JP 7-220817 8/1995
JP 7-335278 * 12/1996

* cited by examiner

*Primary Examiner*—Lincoln Donovan
(74) *Attorney, Agent, or Firm*—McGuireWoods LLP

(57) ABSTRACT

A reed switch unit 44 for detecting a liquid level of a reservoir tank 30 of a master cylinder includes a reed switch 11, including a contact portion 14 sealed in a glass tube 16, and reed portions 18 extending respectively from opposite ends of the glass tube 16 in a direction of an axis thereof. The reed switch unit further includes a unit main body 45 including terminals 50 which support the reed portions 18 and 18, respectively, in electrically-connected relation thereto to fix the reed switch 11. The reed switch 11 is fixed to the unit main body 45 in such a manner that the glass tube 16 is disposed in non-contact relation to the unit main body 45.

10 Claims, 8 Drawing Sheets

REED SWITCH UNIT

BACKGROUND OF THE INVENTION

1. Field of the Invention

This invention relates to a reed switch unit used for detecting a liquid level of a reservoir tank of a master cylinder.

2. Description of the Related Art

A brake device, used in a vehicle, has such a construction that a brake liquid is circulated in a hydraulic circuit provided between a master cylinder, connected to a brake pedal or the like, and a wheel cylinder connected to a wheel brake. A reservoir tank, which holds the brake liquid so as to supply it, is mounted on the master cylinder.

In order to always ensure a proper operation of such a brake device, it is necessary that the brake liquid should always be stored in an amount, not smaller than a predetermined amount, in the reservoir tank. Therefore, a liquid level detection sensor for detecting the position of the liquid level of the brake liquid stored in the reservoir tank, is provided at the reservoir tank so that an alarm can be given to the driver or the like when the brake liquid in the reservoir tank decreases to an amount smaller than the predetermined amount.

The liquid level detection sensor comprises a float installed with a magnet, which can move upward and downward in accordance with the upward and downward movement of the liquid level, and a reed switch unit including a reed switch for detecting the upward and downward movement of the float.

The reed switch is an electrical part in which a contact is closed when the magnet in the float approaches this reed switch.

A conventional reed switch unit is shown in FIGS. 10 and 11.

The reed switch unit 10 comprises a reed switch 11, and a unit main body 12 of a synthetic resin on which the reed switch 11 is mounted.

In the reed switch 11, a contact portion 14 is formed such as to be sealed in a glass tube 16, and a contact of this contact portion 14 is closed when a magnet approaches the reed switch. Inert gas (e.g. nitrogen gas) is sealed in the glass tube 16 to prevent oxidation and dew condensation from developing on the contact portion 14.

Reed portions 18 are provided respectively at opposite ends of the glass tube 16 so as to extend in an axial direction. The reed portions 18 are connected to the contact portion 14.

A right portion (in the drawings) of the unit main body 12, made of a synthetic resin, is formed into a connector portion 12*a* connectable to other electrical circuit, whereas a left portion thereof is formed into a mounting portion 12*b* on which the reed switch 11 is mounted.

Two metal terminals 20 and 20 are provided at the mounting portion 12*b*, and the two reed portions 18 and 18 of the reed switch 11 are connected to these metal terminals 20 and 20, respectively.

Each of the terminals 20 comprises a plate-like body which extends upwardly from the mounting portion 12*b*, and has a slit 22 in which the reed portion 18 is fitted. The terminals 20 are connected respectively to connection terminals 23 indicated in broken lines at the connector portion 12*a*.

The two reed portions 18 and 18 of the reed switch 11 are fitted respectively in the slits 22 and 22, formed respectively in the terminals 20 and 20, and then are soldered to the terminals 20 and 20, respectively, thus fixing the reed switch 11 to the unit main body 12. Since the reed portions 18 are fixed respectively to the terminals 20 by soldering, the physical fixing and electrical connection of the reed portions 18 are both effected positively.

A rib 24 is formed integrally with the unit main body 12, and projects upwardly from that portion of the mounting portion 12*b*, on which the glass tube 16 is to be disposed, in such a manner as to surround side surfaces of the glass tube 16. The rib 24 serves to position the glass tube 16 when fixing the reed switch 11 to the terminals 20.

With the rib 24 thus provided, when mounting the reed switch 11, the glass tube 16 is first received within the rib 24, and then the reed portions 18 are fitted respectively in the slits 22 of the terminals 20, and then are secured thereto by soldering, so that the reed switch 11 is positively fixed at the predetermined mounting position (see, for example, Japanese Patent Unexamined Publication No. Hei. 7-220817).

In the fixing method as described the above, the glass tube 16 may contact the rib 24 surrounding it. Therefore, when the reed switch unit 10 is mounted on a vehicle, there arises a problem that stresses due to vibrations and thermal expansion and thermal contraction develop in the glass tube 16, so that the glass tube 16 can be damaged or deformed.

Besides, the glass tube 16 of the reed switch 11 to be mounted on the unit main body 12 has a dimensional irregularity, and it is inaccurate to perform the positioning of the contact portion 14 by using the glass tube 16 as a reference, to thereby invite a problem that variations occurs in the detection of the liquid level.

SUMMARY OF THE INVENTION

Therefore, this invention has been made in order to solve the above problems, and an object of the invention is to provide a reed switch unit in which damage of a glass tube due to stresses is prevented, and also when fixing a reed switch to a unit main body, the positioning of the reed switch is not performed using the glass tube as a reference.

The above object has been achieved by the following constructions of the invention.

According to the invention, there is provided a reed switch unit for detecting a liquid level of a reservoir tank of a master cylinder, including: a reed switch including a contact portion sealed in a glass tube, and reed portions extending respectively from opposite ends of the glass tube in a direction of an axis thereof; and a unit main body including terminals which support the reed portions, respectively, in electrically-connected relation thereto to fix the reed switch, wherein the reed switch is fixed to the unit main body in such a manner that the glass tube is disposed in non-contact relation to the unit main body.

With this construction, the glass tube does not contact any portion of the unit main body, and thermal stresses, which are produced by heat when mounting the reed switch on the unit main body, and stresses due to vibrations, developing after mounting the reed switch unit on a vehicle, will not be applied to the glass tube, and therefore the glass tube can be prevented from damage.

According to another aspect of the invention, there is provided a reed switch unit for detecting a liquid level of a reservoir tank of a master cylinder, comprising: a reed switch including a contact portion sealed in a glass tube, and reed portions extending respectively from opposite ends of the glass tube in a direction of an axis thereof; and a unit main body including terminals which support the reed portions, respectively, in electrically-connected relation thereto to fix the reed switch, wherein the position of mounting of the reed switch on the unit main body is set by determining the positions of the reed portions.

With this construction, the positioning of the reed switch in its mounting position is effected not by using the glass tube, but by using the reed portion. Therefore, damage, deformation and so on of the glass tube can be prevented, and besides the inaccurate positioning by the use of the glass tube, subjected to dimensional variations, is thus eliminated, and therefore variations in the detection of the liquid level in the reservoir tank can be suppressed.

In the reed switch unit, a stopper wall is formed on the unit main body, and the position of mounting of the reed switch in the axial direction is determined by abutting one end of the reed portion against the stopper wall, and the terminal has a fitting portion which receives the reed portion in such a manner as to determine the position of mounting of the reed switch in a radial direction.

With this construction, when mounting the reed switch on the unit main body, the positioning of the reed switch in the axial direction can be effected by abutting the reed portion against the stopper wall, and the positioning in the radial direction can be effected by fitting the reed portion in the terminal.

The reed portion of the reed switch can be bent at that portion thereof to be fixed to the terminal, and the bent portion is abutted against the terminal, thereby determining the position of mounting of the reed switch. With this construction, when mounting the reed switch on the unit main body, the positioning of the reed switch in the axial and radial directions can be effected by engaging the bent portion of the reed portion with the terminal.

Preferably, the reed portions are fixedly secured respectively to the terminals by resistance welding. With this construction, the electrical connection and physical fixing of the reed switch unit can be positively effected while assuring that the glass tube will not contact the unit main body.

DETAILED DESCRIPTION OF THE PREFERRED EMBODIMENTS

Figure 1:
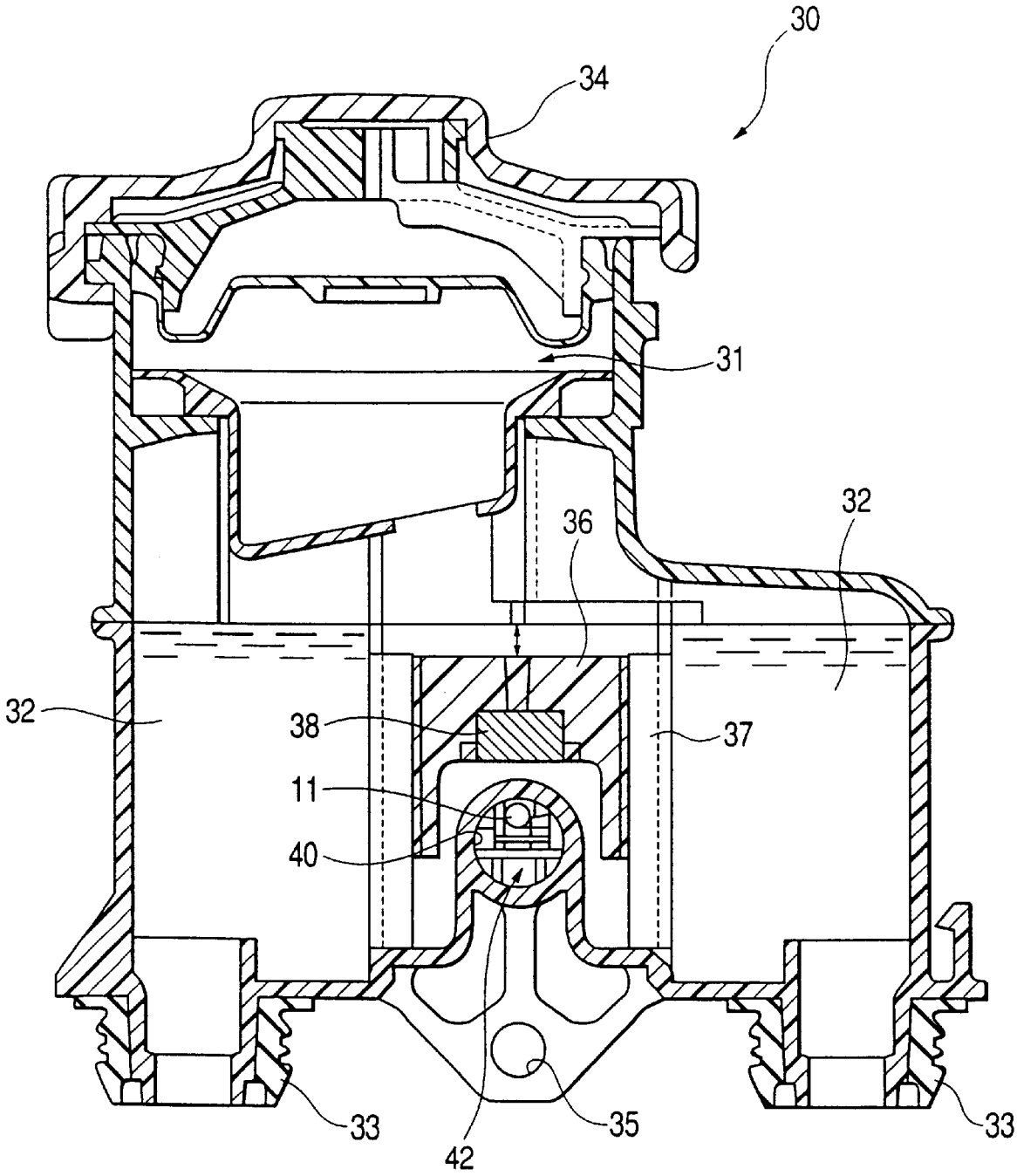
FIG. 1 is a cross-sectional view of a reservoir tank as viewed from a front side thereof.
Figure 2:
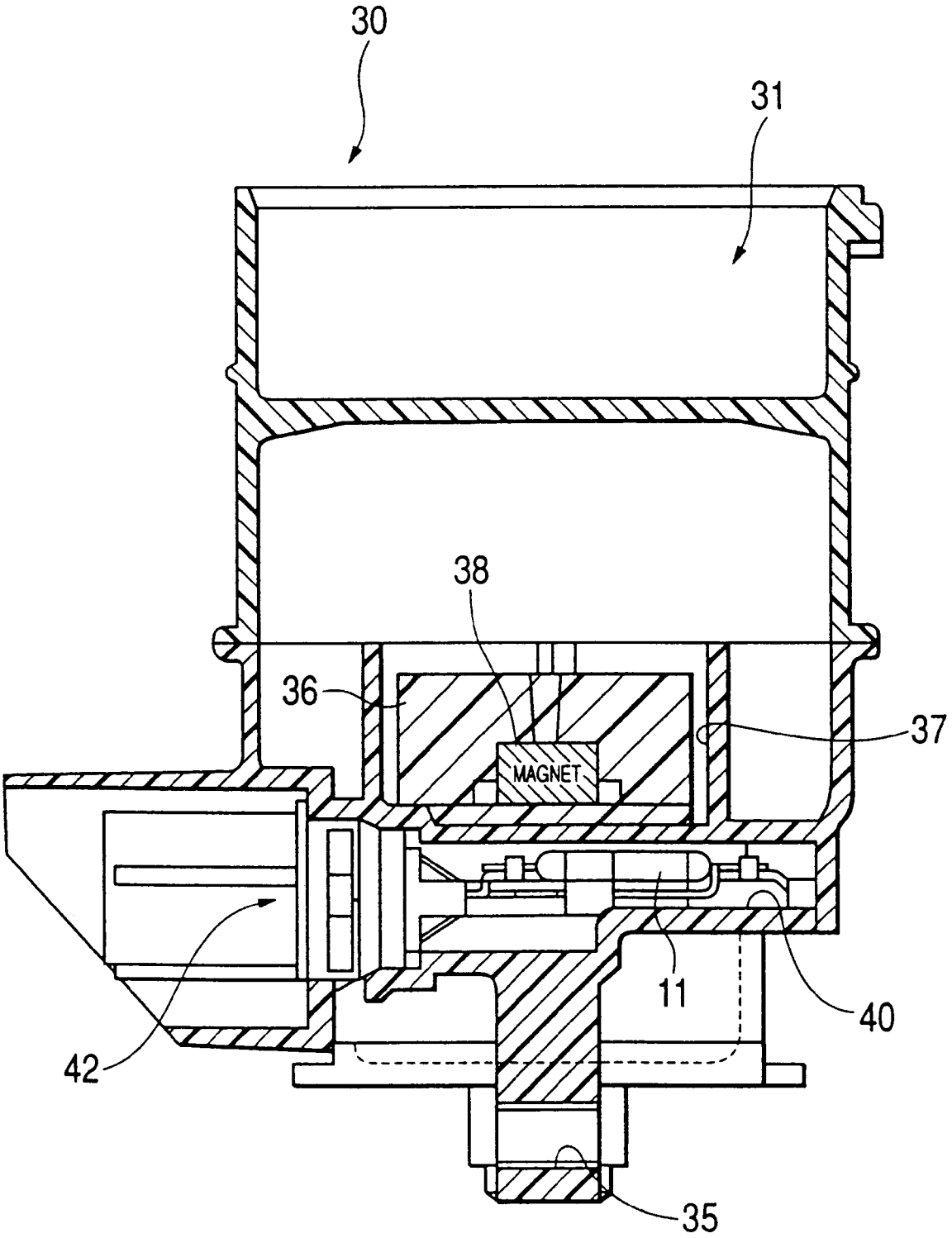
FIG. 2 is a cross-sectional view of the reservoir tank of FIG. 1 as viewed from a side thereof.

FIG. 1 shows one example of a reservoir tank mounted on a master cylinder of a brake device, and the relation between the reservoir tank and a switch unit will now be described.

In embodiments of the invention described below, the same constituent elements as those of the above-mentioned conventional construction, will be designated by identical reference numerals, respectively, and explanation thereof will be omitted.

As described above for the conventional construction, a brake liquid 32 is stored in the reservoir tank 30, and this brake liquid is supplied to the master cylinder (not shown) The reservoir tank 30 is mounted on the master cylinder through rubber packings 33 (shown at a lower portion of FIG. 1). A fixing screw (not shown) is inserted into a fixing hole 35, and fixedly connects the reservoir tank 30 to the master cylinder.

A lid 34 closes an upper opening 31 of the reservoir tank 30, thereby preventing the outflow and evaporation of the brake liquid 32.

A float 36 is received in a float receiving portion 37 provided within the reservoir tank 30 at a central portion thereof. The float 36 is made of a foamed resin having buoyancy relative to the brake liquid 32. This float 36 moves upward and downward (as indicated by an arrow in FIG. 1) in the float receiving portion 37 in accordance with the upward and downward movement of a liquid level of the brake liquid 32. A magnet 38 is installed in this float 36.

A unit receiving hole 40 for receiving a reed switch unit 42 is formed at a lower side of the float receiving portion 37, and is isolated from the brake liquid 32, and is in communication with the exterior of the reservoir tank 30. The reed switch unit 42 received in the unit receiving hole 40, and the float 36 jointly function as a liquid level detection sensor for detecting the liquid level of the brake liquid 32 in the reservoir tank 30.

The liquid level detection sensor operates such that a reed switch 11 mounted on the reed switch unit 42 detects magnetic flux of the magnet 38 installed in the float 36 in accordance with the upward and downward movement of the float 36.

More specifically, when the liquid level of the brake liquid 32 in the reservoir tank 30 falls, the magnet 38 approaches the reed switch 11, so that a contact portion of the reed switch 11 is closed, thereby detecting the fall of the liquid level of the brake liquid 32.

Next, a first embodiment of a reed switch unit of the invention will be described with reference to FIGS. 3 to 6. FIG. 5 is a cross-sectional view of the reed switch unit taken along the line D—D of FIG. 3.

The reed switch unit 44 of this embodiment comprises a reed switch 11, similar to the reed switch of the above-mentioned conventional construction, and a unit main body 45 made of a synthetic resin.

A right portion of the unit main body 45 is formed into a connector portion 45*a* connectable to other electrical circuit, whereas a left portion thereof is formed into a mounting portion 45*b* on which the reed switch 11 is mounted.

Terminals 50 and 50 are provided at predetermined portions of the mounting portion 45*b*, respectively. Reed portions 18 and 18 are fixedly connected respectively to the terminals 50 and 50 to thereby mount the reed switch 11 on the unit main body 45. The terminals 50 and 50 are constructed by metal members, respectively, which are formed integrally respectively with connection terminals 23 and 23 provided within the connector portion 45*a*.

Each of the terminals 50 includes a mounting portion 52, on which the reed portion 18 is adapted to mount, and a bent piece portion 54 which is formed integrally with the mounting portion 52 and is bent to oppose to the mounting portion 52 so that the reed portion 18 can be held between the mounting portion 152 and the bent piece portion 54. The bent piece portion 54 and the mounting portion 52 jointly assume a generally U-shape or V-shape as viewed from the front side thereof (FIG. 6).

Figure 3:
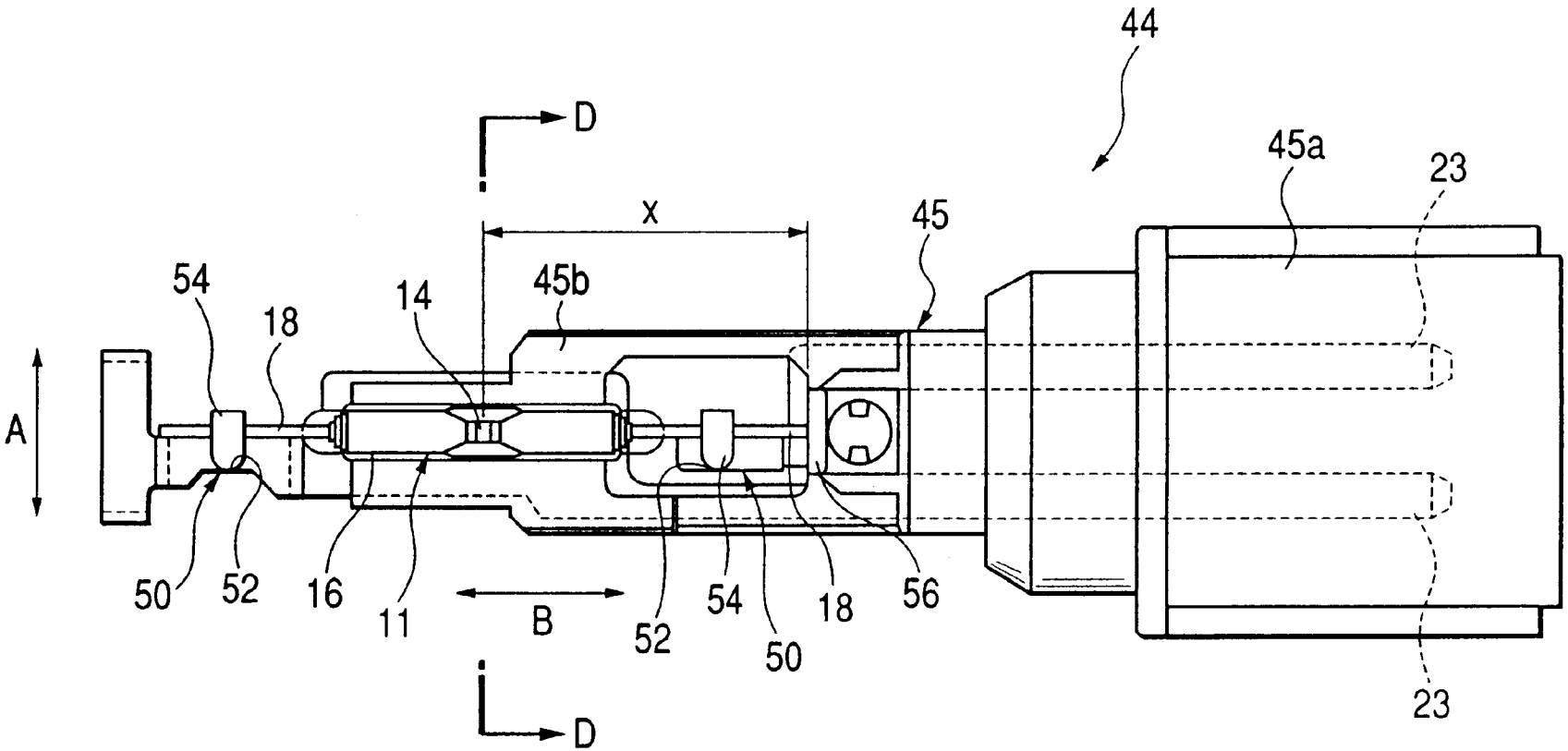
FIG. 3 is a plan view of a reed switch unit of the invention.
Figure 6:
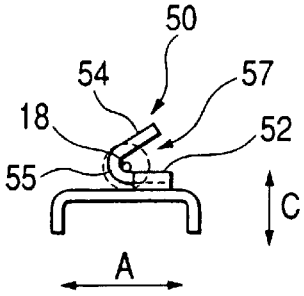
FIG. 6 is a front-elevational view showing a metal portion of the reed switch unit of FIG. 3.

Then terminals 50 assume the above-mentioned configuration, and therefore when mounting the reed switch 11 on the unit main body 45, each reed portion 18 is fitted into the corresponding terminal 50 through an open side 57 thereof between the bent piece portion 54 and the mounting portion 52, and is pressed against an interconnecting portion 55 (defining the bottom of the V- or U-shaped body), interconnecting the bent piece portion 54 and the mounting portion 52, thereby performing the positioning of the reed switch 11 in a direction of the width thereof (that is, in a direction of arrow A in FIGS. 3 and 6).

The positioning of the reed switch 11 in a direction of the height thereof (that is, in a direction of arrow C in FIGS. 4 and 6) is determined at the time when the reed portions 18 are put on the mounting portions 52, respectively.

Namely, the term "radial direction of the reed switch" means a concept including both the direction of the width and the direction of the height. In the specification, this term will hereafter be explained based on this concept.

Figure 4:
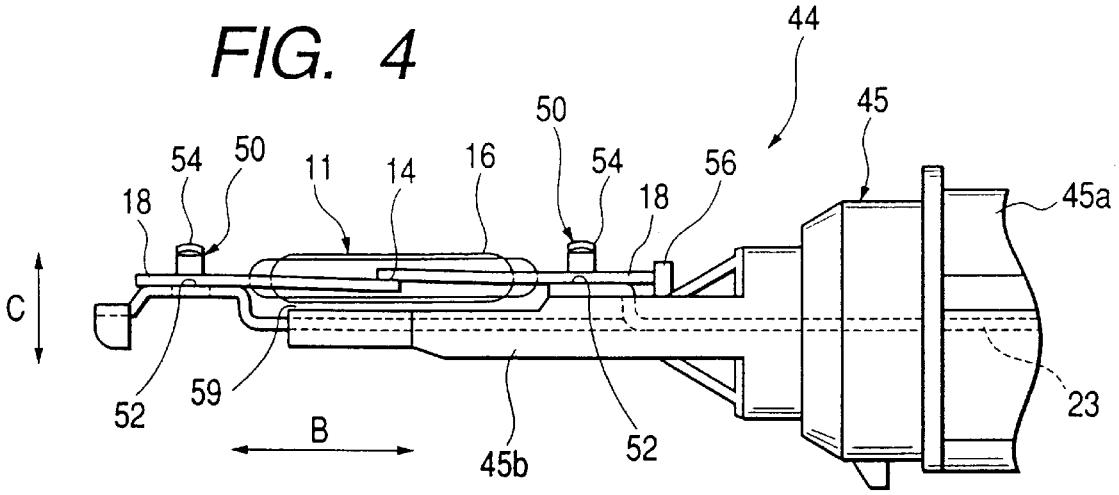
FIG. 4 is a side-elevational view of the reed switch unit of FIG. 3.
Figure 5:
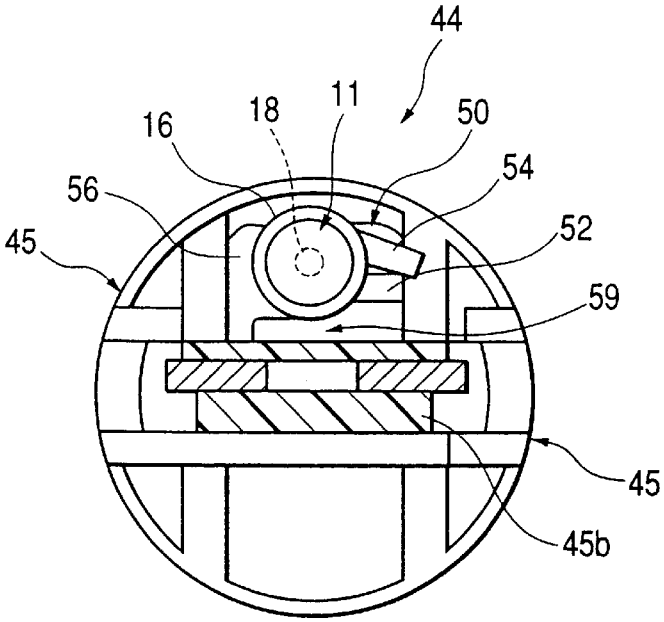
FIG. 5 is a cross-sectional view of the reed switch unit taken along the line D—D of FIG. 3.

A stopper wall 56 is formed on the mounting portion 45*b* disposed between the connector portion 45*a* and the terminal 50 close to the connector portion 45*a* so as to project upwardly (see FIG. 4). The stopper wall 56 is formed integrally with the unit main body 45.

The stopper wall 56 is provided for performing the positioning of the reed switch 11 in the direction of the axis thereof ( that is, in a direction of arrow B in FIGS. 3 and 4) when mounting the reed switch 11 on the unit main body 45. Namely, when mounting the reed switch 11 on the unit main body 45, the distal end of the reed portion 18, disposed close to the connector portion, is abutted against the stopper wall 56, thereby performing the positioning of the reed switch 11 in the axial direction.

In this case, however, it is necessary to accurately cut the reed portion 18 such that a length X of the reed portion 14 from a contact portion 14 is equal to a length from the stopper wall 561 to the center of a glass tube 16. Unless the length x of the reed portion 18 is thus beforehand determined accurately, the positioning of the reed switch 11 can not be accurately performed even if the end of the reed portion 18 is merely abutted against the stopper wall 56.

After the reed switch 11 is attached to the terminals 50 on the unit main body 45 in a positioned manner, the bent piece portion 54 of each terminal 50 is bent to completely close the open side 57, and at the same time fusing (fusion bonding by heat) is applied. The reed switch 11 is completely fixed to the unit main body 45 by this fusing operation.

The fixing of the reed portion 18 to the terminal 50 can be performed by resistance welding such as spot welding and projection welding instead of using the above fusing operation. With such resistance welding, the physical fixing and the electrical connection can both be performed positively. The fixing of the reed portion 18 to the terminal 50 may be performed by soldering.

Thus, in this embodiment, any member of the unit main body 45 does not contact with the glass tube 16. Besides, since the glass tube 16 is supported by the reed portions 18 respectively extending from the contact portion 14, the reed switch 11 is fixed in such a manner that the glass tube 16 is spaced from the unit main body 45, with a gap 59 (FIGS. 4 and 5) formed between the glass tube 16 and the mounting portion 45*b* of the unit main body 45. Therefore, even when the reservoir tank receiving the reed switch unit 44 is mounted on a vehicle, stresses due to vibrations and thermal expansion and contraction will not develop in the glass tube 16, and therefore the glass tube 16 can be prevented from damage and so on.

Besides, the mounting position is determined using the reed portions 18 instead of using the glass tube 16 as a reference, and therefore the glass tube 16 will not contact any portion, and the mounting operation can be carried out in such a manner that any stress will not develop in the glass tube 16, and also the accurate positioning can be achieved, and therefore variations in the detection of the liquid level in the reservoir tank can be suppressed.

Next, a modification of the above first embodiment, in which the shape of terminals is different, will be described with reference to FIG. 7. The same constituent elements as those of the first embodiment, will be designated by identical reference numerals, respectively, and explanation thereof will be omitted.

In a reed switch unit 64 of this embodiment, the terminals are different in shape from the terminals of the first embodiment. More specifically, in this embodiment, each of the terminals 60 has the same construction as described above for the conventional structure, and has a slit 62 for interposing the reed portion 18.

In this embodiment, in which each of the terminals 60 has the slit 62 for interposing the reed portion 18, also, any member, which is in contact with the glass tube 16 of the reed switch 11, is not provided on the unit main body 45 so that the glass tube 16 will not contact such a member. In addition, the reed switch 11 is fixed in such a manner that the glass tube 16 is spaced from the unit main body 45, with a gap formed between the glass tube 16 and the mounting portion 45*b* of the unit main body 45.

Therefore, even when the reservoir tank receiving the reed switch unit 64 is mounted on a vehicle, stresses due to vibrations and thermal expansion and contraction will not develop in the glass tube 16, and therefore the glass tube 16 can be prevented from damage and so on.

In this construction, the position of the reed portion 18 in a direction of the width (that is, in a direction of arrow A) is determined when the reed portion 18 is fitted into the slit 62, and the position of the reed portion 18 in a direction of the height is determined when the reed portion 18 is pushed to the bottom of the slit 62. The positioning of the reed switch 11 in an axial direction is performed by abutting the end of the reed portion 18 against the stopper wall 56 to thereby regulate the movement in the axial direction (that is, in a direction of arrow B).

Namely, in this reed switch unit 64, the positioning of the reed switch 11 can be effected without using the glass tube 16 as a reference, and therefore the glass tube 16 will not contact any portion, and any stress will not develop in the glass tube 16, thus preventing the glass tube 16 from damage and so on, and also the accurate positioning can be achieved, and therefore variations in the detection of the liquid level in the reservoir tank can be suppressed.

A second embodiment of the invention will be described with reference to FIGS. 8 and 9.

Figure 8:
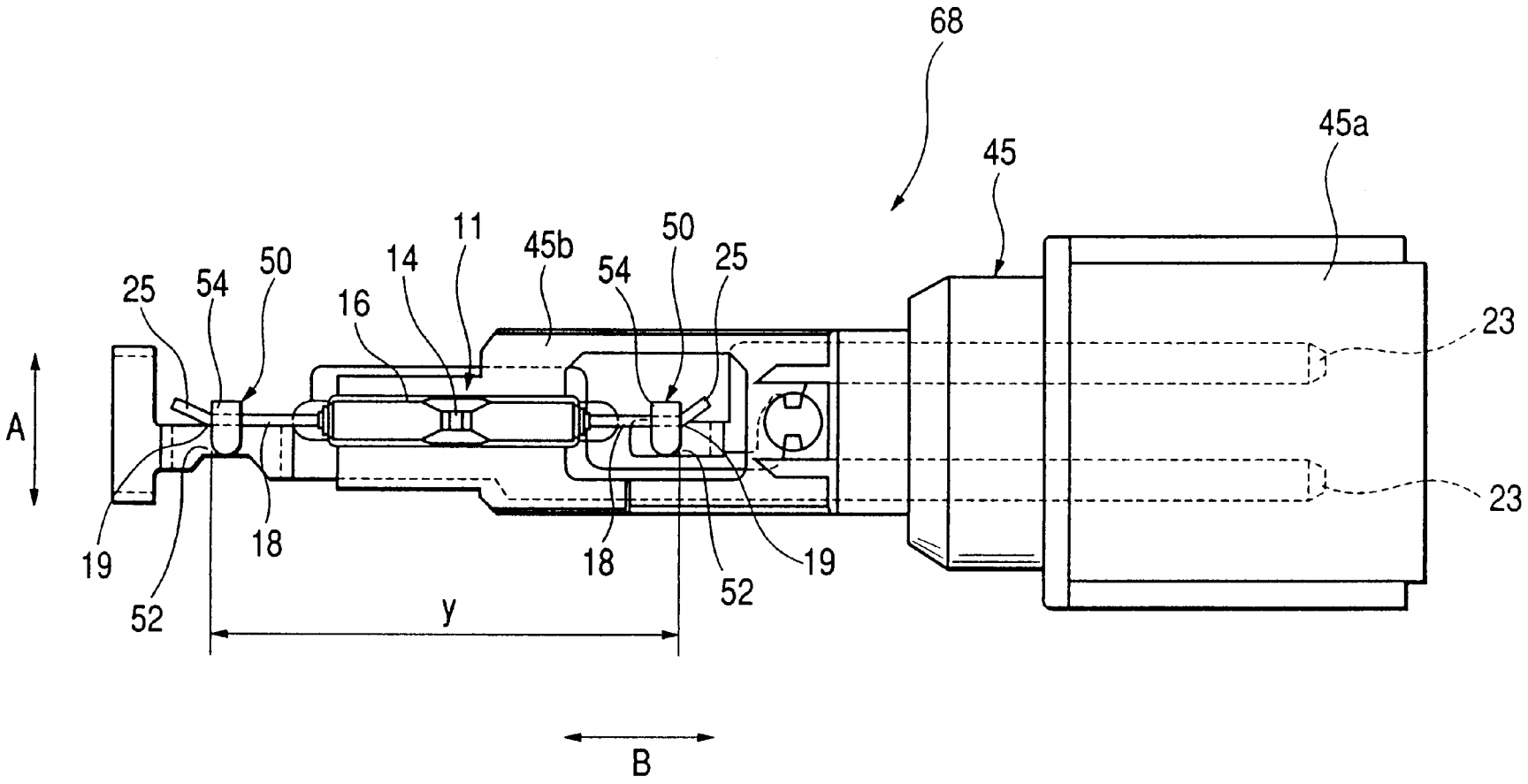
FIG. 8 is a plan view of a second embodiment of a reed switch unit of the invention.

In a reed switch unit 68 of FIG. 8, each of reed portions 18 of agreed switch 11 is not straight, but is bent at a predetermined portion thereof.

Terminals 50 of this reed switch unit 68 have the same shape as that of the terminals 50 of the reed switch unit 44 shown in FIGS. 3 to 6, but a unit main body 45 of this reed switch unit 68 differs from the unit main body 45 of the reed switch unit 44 in that any stopper wall 56 is not provided.

The reed portion 18 is bent at a portion 19 thereof to be fixed to the terminal 50. The portion 19 to be fixed to the terminal 50 is so bent that a distal end portion 25 of the reed portion 18 is directed toward an interconnecting portion 55 (see FIG. 6) of the terminal 50 (disposed in the direction of the width (i.e., a direction of arrow A)), interconnecting bent piece portion 54 and a mounting portion 52.

In this embodiment, the reed portion 18 is thus bent at its portion 19 to be fixed to the terminal 50 in such a manner that the distal end portion is directed toward the interconnecting portion 55 of the terminal 50. Therefore, the distal end portion 25 of the reed portion 18, extending from the bent portion 19, is abutted against the interconnecting portion 55 of the terminal 50, thereby regulating the movement of the reed portion in the axial direction.

With this construction, when mounting the reed switch 11 on the unit main body 45, the positioning of the reed switch in the axial direction (that is, in a direction of arrow B) can be performed through the distal end portions 25 and 25 of the two reed portions 18 which regulate the axial movements of these reed portions, respectively.

The positioning of the reed switch in the direction of the width (that is, in a direction of arrow A) is performed by fitting each reed portion 18 into the corresponding terminal 50 through the open side 57 thereof and then by pressingly abutting the reed portion 18 against the interconnecting portion 515 interconnecting the bent piece portion 54 and the mounting portion 52 (FIG. 6), as described above for the first embodiment.

The positioning of the reed switch in the direction of the height is performed at the time when the reed portions 18 are mounted on the mounting portions 52, respectively, as described above for the first embodiment.

In the reed switch unit 68 of this embodiment, also, a glass tube 16 is fixed in such a manner that it does not contact any portion of the unit main body 45, and besides the positioning of the reed switch 11 can be performed without using the glass tube 16 as a reference.

Therefore, even when the reservoir tank receiving the reed switch unit 68 is mounted on a vehicle, stresses due to vibrations and thermal expansion and contraction will not develop in the glass tube 16, and therefore the glass tube 16 can be prevented from damage and so on, and also the accurate positioning can be achieved, and therefore variations in the detection of the liquid level in the reservoir tank can be suppressed.

Figure 7:
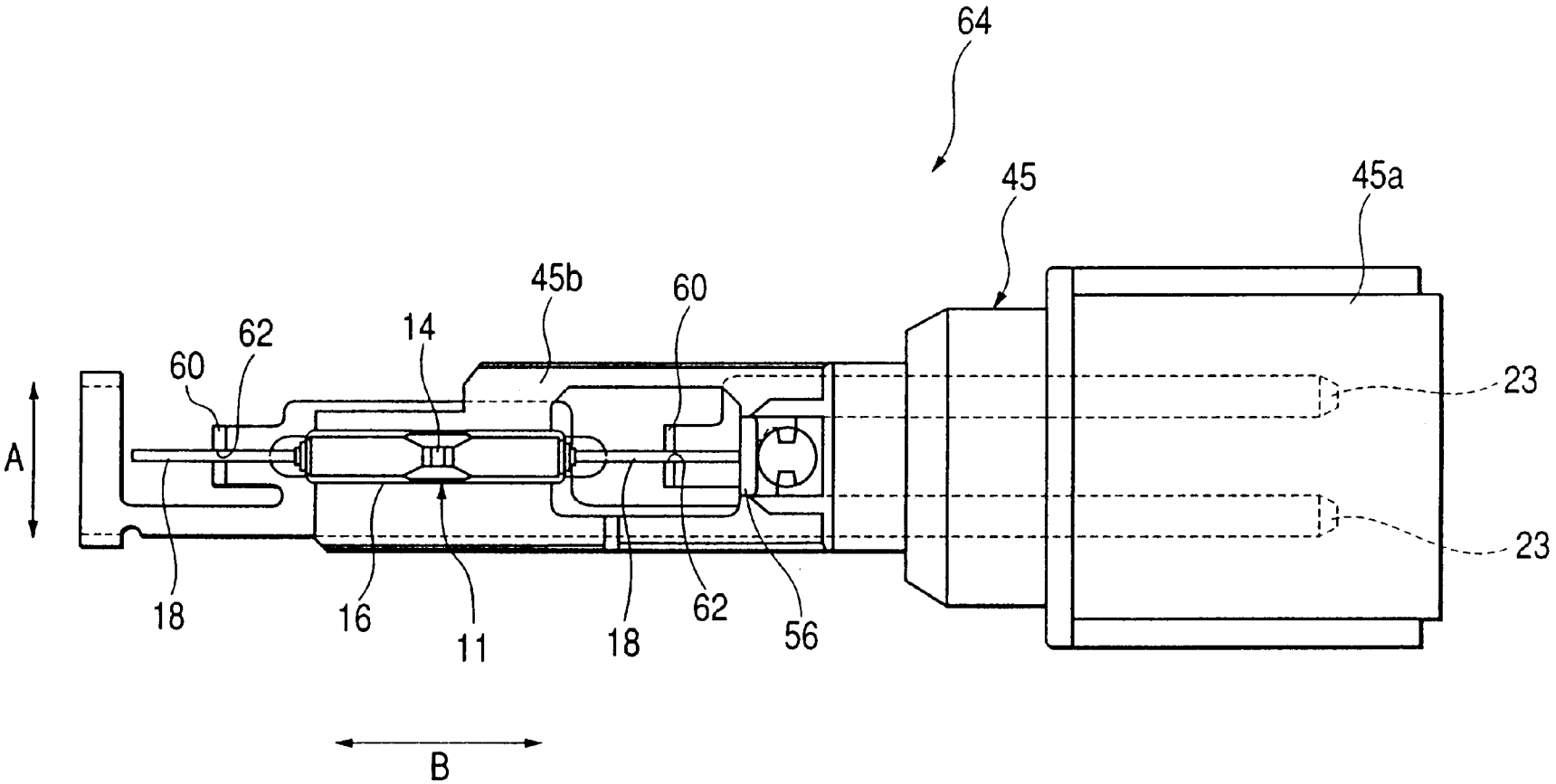
FIG. 7 is a plan view of a modification of the embodiment of FIG. 3.

In this embodiment of FIG. 8, the terminals may be replaced by such terminals as described above for the conventional construction and the embodiment of FIG. 7, each of such terminals (FIG. 9) having a slit 62 for interposing the reed portion 18.

Figure 9:
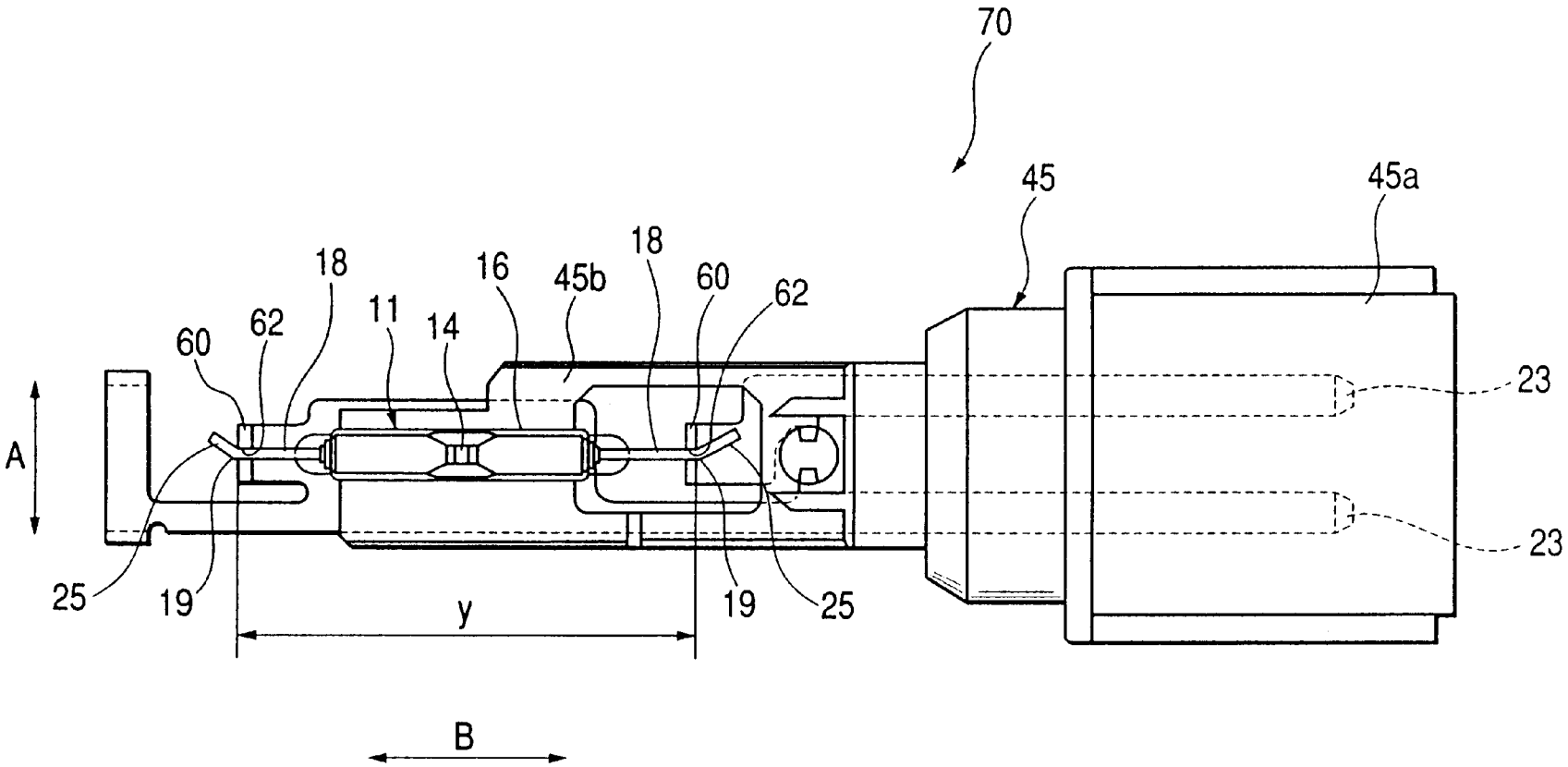
FIG. 9 is a plan view of a modification of the second embodiment of FIG. 8.
Figure 10:
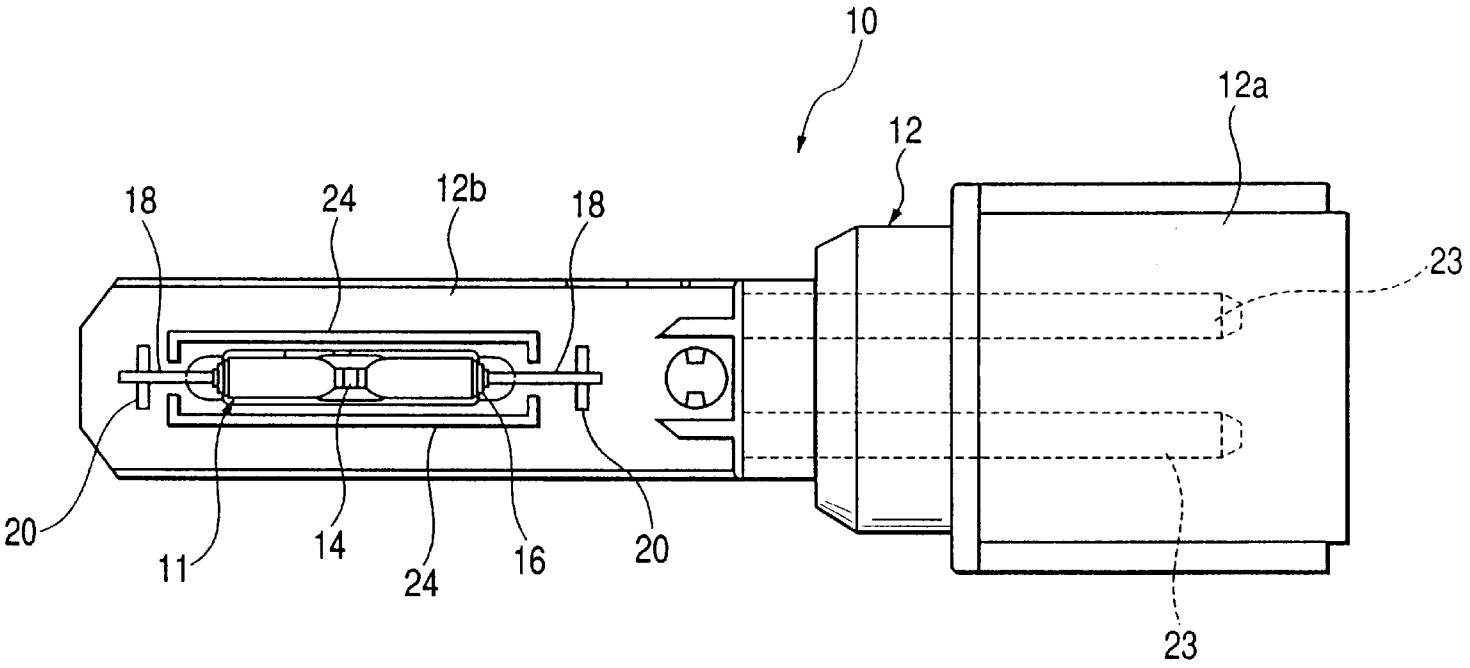
FIG. 10 is a plan view of a conventional reed switch unit.
Figure 11:
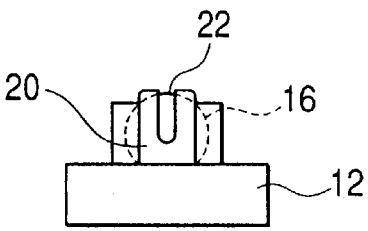
FIG. 11 is a front-elevational view of the reed switch unit of FIG. 10.

In a reed switch unit 70 shown in FIG. 9, a portion 19 of each reed portion 18 to be fixed to the terminal 60 in an interposed manner is bent in a direction of the width (that is, in a direction of arrow A). A distal end portion 25 of the reed portion 18 extending from the bent portion 19 may be directed toward either side of the widthwise direction.

In this reed switch unit 70, also, when mounting the reed switch 11 on the unit main body 45, the positioning of the reed switch in the axial direction (that is, in a direction of arrow B) can be performed through the bent portions 19 of the reed portions 18 which abut respectively against the terminals 60 to thereby regulate the movement of the reed switch 11.

The positioning of the reed switch in the direction of the width (that is, in a direction of arrow A) is performed merely by fitting each reed portion 18 into the slit 62 in the corresponding terminal 60 since the movement of the reed portion 18 in the slit 62 is regulated in the direction of the diameter.

The positioning of the reed switch in the direction of the height is performed at the time when each reed portion 18 fitted into the slit 62, and is pressed against the bottom of the slit 62, as described above for the first embodiment.

In the reed switch unit 70 of this embodiment, also, a glass tube 16 is fixed in such a manner that it does not contact any portion of the unit main body 45, and besides the positioning of the reed switch 11 can be effected without using the glass tube 16.

Therefore, even when the reservoir tank, containing the reed switch unit 70, is mounted on a vehicle, stresses due to vibrations and thermal expansion and contraction will not develop in the glass tube 16, and therefore the glass tube 16 can be prevented from damage and so on, and also the accurate positioning can be achieved, and therefore variations in the detection of the liquid level in the reservoir tank can be suppressed.

In FIGS. 8 and 9, it is necessary to bend the two reed portions 18 such that the distance y between the bent portions 19 and 19 of the two reed portions 18 is equal to the distance between the two terminals 50 (or 60).

In the second embodiment shown in FIGS. 8 and 9, although the bent portion 19 is formed at each of the two reed portions 18 and 18 of the reed switch 11, it is not always necessary to bend both of the two reed portions 18.

Namely, in the case where one of the two reed portions 18 is bent (not shown), the two reed portions 18 are first fitted respectively into the two terminals 50 (or 60), and then the reed switch 11 is moved in the axial direction so as to abut the distal end portion of the reed portion 18, extending from the bent portion 19, against the corresponding terminal 50 (or 60).

By doing so, when the distal end portion 25, extending from the bent portion 19, is abutted against the terminal 50 (or 60), the axial movement of the reed switch is regulated, thus performing the positioning of the reed switch in the axial direction. The positioning in the direction of the width and the positioning in the direction of the height are performed when each reed portion is fitted into the terminal 50 (or 60) since the movement of the reed portion is regulated, as described above.

Although the preferred embodiments of the invention have been described above, the invention is not limited to these embodiments, and various modifications can be made without departing from the scope of the invention.

The reed switch unit of the invention comprises the reed switch, including the contact portion, sealed in the glass tube, and the reed portions extending respectively from the opposite ends of the glass tube in the direction of the axis thereof, and the unit main body including the terminals which support the reed portions, respectively, in electrically-connected relation thereto to fix the reed switch, and the reed switch is fixed to the unit main body in such a manner that the glass tube is disposed in non-contact relation to the unit main body. Therefore, even when the reservoir tank, containing the reed switch unit, is mounted on a vehicle, stresses due to vibrations and thermal expansion and contraction will not develop in the glass tube, thus preventing the glass tube from damage and so on.

The position of mounting of the reed switch on the unit main body is set by determining the positions of the reed portions, and therefore the positioning, which has heretofore been effected using the glass tube, does not need to be carried out. Therefore, the inaccurate positioning by the use of the glass tube, subjected to dimensional variations, is thus eliminated, and therefore variations in the detection of the liquid level in the reservoir tank can be suppressed. And besides, there is not provided any portion for contact with the glass tube serving as a positioning reference, and therefore any stress will not develop in the glass tube, thus preventing the glass tube from damage and so on.

What is claimed is:

1. A reed switch unit for detecting a liquid level of a reservoir tank of a master cylinder, comprising:

a reed switch including a glass tube, and a pair of reed portions extending respectively from opposite ends of said glass tube in a direction of an axis thereof, said pair of reed portions cooperatively defining a contact portion which is sealed in said glass tube;

a unit main body including terminals respectively supporting and electrically connectable to said reed portions, said terminals having a stepped portion, wherein said reed switch is fixed to said unit main body at said stepped portion of said terminals in such a manner that said glass tube is spaced apart from said unit main body, and, wherein said reed portions are respectively fixed to said terminals by resistance welding.

2. A reed switch unit for detecting a liquid level of a reservoir tank of a master cylinder, comprising:

a reed switch including a glass tube, and a pair of reed portions extending respectively from opposite ends of said glass tube in a direction of an axis thereof, said pair of reed portions cooperatively defining a contact portion which is sealed in said glass tube;

a unit main body including terminals respectively supporting and electrically connectable to said reed portions; and a stopper wall positioned on said unit main body and abutting one of said pair of reed portions, the stopper wall determining a mounting position of said reed switch on said main body, wherein said stopper wall positions said reed switch in the axial direction with respect to the unit main body, and said terminals include an interposing portion at least partially surrounding an outer periphery of said pair of reed portions for positioning said reed switch in a radial direction.

3. A reed switch unit for detecting a liquid level of a reservoir tank of a master cylinder, comprising:

a reed switch including a glass tube, and a pair of reed portions extending respectively from opposite ends of said glass tube in a direction of an axis thereof, said pair of reed portions cooperatively defining a contact portion which is sealed in said glass tube;

a unit main body including terminals respectively supporting and electrically connectable to said reed portions;

a stopper wall positioned on said unit main body and abutting one of said pair of reed portions, the stopper wall determining a mounting position of said reed switch on said unit main body by positioning said reed switch in the axial direction with respect to the unit main body, the axial direction is a position for determining said contact point within said glass tube;

a slit, formed in said terminals, at least partially surrounding an outer periphery of said pair of reed portions for positioning said reed switch in a radial direction.

4. A reed switch unit for detecting a liquid level of a reservoir tank of a master cylinder, comprising:

a reed switch including a glass tube, and a pair of reed portions extending respectively from opposite ends of said glass tube in a direction of an axis thereof, said pair of reed portions cooperatively defining a contact portion which is sealed in said glass tube;

a unit main body including terminals respectively supporting and electrically connectable to said reed portions;

a stopper wall positioned on said unit main body and abutting one of said pair of reed portions, the stopper wall determining a mounting position of said reed switch on said unit main body by positioning said reed switch in the axial direction with respect to the unit main body, the axial direction is a position for determining said contact point within said glass tube;

an interposing portion at least partially surrounding an outer periphery of said pair of reed portions for positioning said reed switch in a radial direction, said interposing portion.

5. The reed switch unit according to claim 2, wherein said reed portions includes a bent portion to be bent at a fixed position of said terminals; and said bent portion is abutted against said terminals to position the mounting position of said reed switch after said reed portions are electrically connectable to said terminals.

6. A reed switch unit for detecting a liquid level of a reservoir tank of a master cylinder, comprising:

a reed switch including a glass tube, and a pair of reed portions extending respectively from opposite ends of said glass tube in a direction of an axis thereof, said pair of reed portions cooperatively defining a contact portion which is sealed in said glass tube;

a unit main body including terminals respectively supporting and electrically connectable to said reed portions; and a stopper wall positioned on said unit main body and abutting one of said pair of reed portions, the stopper wall determining a mounting position of said reed switch on said unit main body, wherein said reed portions are respectively fixed to said terminals by resistance welding.

7. A reed switch unit for detecting a liquid level of a reservoir tank of a master cylinder, comprising:

a reed switch including a glass tube, and a pair of reed portions extending respectively from opposite ends of said glass tube in a direction of an axis thereof, said pair of reed portions cooperatively defining a contact portion which is sealed in said glass tube and which includes a bent portion; and a unit main body including terminals respectively supporting and electrically connectable to said reed portions, said bent portion of said reed portions to be bent at a fixed position of said terminals and is abutted against said terminals to position the mounting position of said reed switch;

a mounting position of said reed switch on said unit main body is set by determining the positions of said reed portions.

8. The reed switch unit according to claim 6, wherein said reed portion includes a bent portion to be bent at a fixed position of said terminals; and said bent portion is abutted against said terminals to position the mounting position of said reed switch after said reed portions are electrically connectable to said terminals.

9. The reed switch unit according to claim 1, wherein said glass tube is spaced apart from said unit main body thereby forming a gap between an entire length of said glass tube and said unit main body.

10. The reed switch unit according to claim 1, wherein:

a positioning of the reed switch in a direction of a height thereof is determined at a time when the reed portions are mounted on mounting portions, said mounting portions determine the positioning of the height, and the positioning of the height determines a gap formed between an entire length of said glass tube and said unit main body.

* * * * *